US009062591B2

(12) United States Patent
Bitzer et al.

(10) Patent No.: US 9,062,591 B2
(45) Date of Patent: Jun. 23, 2015

(54) FAN SYSTEM FOR A COOLING SYSTEM OF AN INTERNAL COMBUSTION ENGINE

(71) Applicant: Robert Bosch GmbH, Stuttgart (DE)

(72) Inventors: Harold Bitzer, Buehl (DE); Andreas Mueller, Herxheim (DE); Michael Schermann, Appenweier (DE)

(73) Assignee: Robert Bosch GmbH, Stuttgart (DE)

( * ) Notice: Subject to any disclaimer, the term of this patent is extended or adjusted under 35 U.S.C. 154(b) by 69 days.

(21) Appl. No.: 13/906,331

(22) Filed: May 30, 2013

(65) Prior Publication Data

US 2013/0319353 A1 Dec. 5, 2013

(30) Foreign Application Priority Data

May 31, 2012 (DE) ..... 10 2012 209 199

(51) Int. Cl.

| | |
|---|---|
| ***F04B 35/04*** | (2006.01) |
| ***F01P 7/10*** | (2006.01) |
| ***H02K 7/00*** | (2006.01) |
| ***H02K 1/14*** | (2006.01) |
| ***F01P 1/00*** | (2006.01) |
| ***F04D 25/06*** | (2006.01) |
| *F01P 5/04* | (2006.01) |

(52) U.S. Cl.

CPC ..... *F01P 1/00* (2013.01); *F01P 2005/046* (2013.01); *F04D 25/062* (2013.01)

(58) Field of Classification Search

USPC ..... 123/41.49; 310/40.5, 40 R, 63, 261.1; 415/97, 98, 99, 208.1, 208.2; 416/179, 416/181, 182, 185, 188, 213 R; 417/423.12, 417/423.13, 423.14

See application file for complete search history.

(56) References Cited

U.S. PATENT DOCUMENTS

| | | | | |
|---|---|---|---|---|
| 4,603,271 | A * | 7/1986 | Maruyama et al. | 310/62 |
| 4,767,285 | A * | 8/1988 | Jyoraku et al. | 417/366 |
| 4,949,022 | A * | 8/1990 | Lipman | 318/400.08 |
| 5,244,347 | A * | 9/1993 | Gallivan et al. | 416/189 |
| 6,129,528 | A * | 10/2000 | Bradbury et al. | 417/423.1 |
| 6,170,275 | B1 * | 1/2001 | Ueno et al. | 62/186 |
| 7,317,267 | B2 * | 1/2008 | Schmid et al. | 310/51 |
| 7,903,406 | B2 * | 3/2011 | Takemoto | 361/695 |
| 8,029,251 | B2 * | 10/2011 | Oguma | 417/354 |
| 2004/0191088 | A1 * | 9/2004 | Matsumoto | 417/354 |
| 2006/0280623 | A1 * | 12/2006 | Yu et al. | 417/354 |
| 2007/0020085 | A1 * | 1/2007 | Takemoto | 415/93 |
| 2008/0112810 | A1 * | 5/2008 | Nagamatsu et al. | 416/204 R |
| 2012/0003109 | A1 * | 1/2012 | Kitamura | 417/423.14 |

FOREIGN PATENT DOCUMENTS

KR 100872553 B * 7/2008

* cited by examiner

*Primary Examiner* — Marguerite McMahon
*Assistant Examiner* — Tea Holbrook
(74) *Attorney, Agent, or Firm* — Michael Best & Freidrich LLP

(57) ABSTRACT

Fan system (1) for a cooling system of an internal combustion engine, having an electric machine (2) and an impeller wheel (3), wherein the electric machine (2) comprises a pole housing (20), which is rotatably mounted by means of a bearing (21, 22), wherein the impeller wheel (3) is coupled to the pole housing (20) of the electric machine (2), wherein the impeller wheel (3) has a first engagement element (40), and the pole housing (20) has a second engagement element (50) which corresponds to the first engagement element (40), wherein the two engagement elements (40, 50) engage one in the other in such a way that they form a bearing seat (212) for the bearing (21) of the pole housing (20).

9 Claims, 7 Drawing Sheets

FAN SYSTEM FOR A COOLING SYSTEM OF AN INTERNAL COMBUSTION ENGINE

BACKGROUND OF THE INVENTION

The invention relates to a fan system for a cooling system of an internal combustion engine having an electric machine and an impeller wheel, wherein the electric machine comprises a pole housing which is rotatably mounted by means of a bearing, and wherein the impeller wheel is coupled to the pole housing of the electric machine.

Fan systems having an electric machine which is embodied as an external rotor are known. In order to attach an impeller wheel to a pole housing of the electric machine, what is referred to as a joining mandrel usually has to be inserted between an axle of the pole housing and the fan during assembly of the electric machine and is removed again after the fan is screwed to the pole housing. Joining play between the joining mandrel and the axle or between the joining mandrel and the fan is necessary for this. This joining play has to be taken into account in addition to the component tolerances of the fan system, and therefore at the same time increases the radial play between the fan and the axle.

SUMMARY OF THE INVENTION

The object of the invention is to make available a fan system with relatively small component tolerances and with improved attachment of the fan to the electric machine.

Accordingly, the impeller wheel has a first engagement element and the pole housing has a second engagement element which is designed to correspond to the first engagement element, wherein the two engagement elements are embodied in such a way that they engage one in the other, at least partially couple the pole housing and the impeller wheel to one another, and form a bearing seat for the bearing of the pole housing of the electric machine.

This has the advantage that during assembly the fan can be mounted easily and at the same time it is possible to dispense with the assembly process of screwing the impeller wheel securely to the pole housing of the electric machine. In addition, the impeller wheel can easily be centered, with the result that the impeller wheel is oriented precisely in the direction of a rotational axis of the electric machine and therefore has low susceptibility to noise as a result of a possible unbalance. The risk of the pole housing or the fan running up against further components of the fan is also avoided.

In a further embodiment, the engagement elements of the pole housing or of the impeller wheel form an annular bearing seat which is configured to accommodate a roller bearing or a sliding bearing. This has the advantage that an injection molding process for attaching the sliding bearing is avoided, and the fan system can be manufactured easily and cost-effectively.

The impeller wheel preferably has a stop which is configured to define an axial position of the bearing in at least one direction.

In a further embodiment, the electric machine has a further bearing which is arranged in the pole housing, wherein the further bearing is arranged and configured with respect to the above-mentioned bearing in such a way that the pole housing and the impeller wheel are rotatably mounted and are secured both radially and axially in their positions. In this way it is easily possible to determine the position of the rotatable pole housing and impeller wheel elements.

In a further embodiment, the first engagement element is embodied as a cutout or depression in the pole housing. In this way, the pole housing and/or the first engagement element can easily be formed in a deep drawing method or in an injection molding method.

In a further embodiment, the second engagement element has at least one rib which is designed to engage in the first engagement element, in particular in the bulge or cutout of the first engagement element. In this way, the impeller wheel can be easily coupled to the pole housing.

In a further embodiment, at least two ribs are provided which are connected in an upper region by at least one section in the form of a partial ring. This permits a particularly stable second engagement element to be made available.

In a further embodiment, a coupling device is provided which comprises a first coupling element and a second coupling element which is designed to correspond to the first, wherein the first coupling element is arranged on the pole housing and the second coupling element is arranged on the impeller wheel, wherein the coupling elements are configured to engage one in the other and to transmit a torque. In this way, during the starting process of the fan system the risk of a contacting process between the pole housing and tangentially arranged further run-up webs can be significantly reduced and/or avoided.

A particularly good way of reducing the risk of the contact process has proven to be if the first coupling element comprises at least one web and the second coupling element is embodied as a recess, wherein the web engages under tension in the recess.

In a further embodiment, the second coupling element is embodied as a recess embodied in the form of a partial ring, and comprises a sliding contour with at least a first section and a second section, wherein the first section has a first radius and the second section has a second radius, wherein the second radius is smaller than the first radius. In this way it is particularly advantageously possible to reduce the noise emissions during the starting process of the fan system.

BRIEF DESCRIPTION OF THE DRAWINGS

The invention will be explained in more detail below with reference to figures, in which.

DETAILED DESCRIPTION

Figure 1:
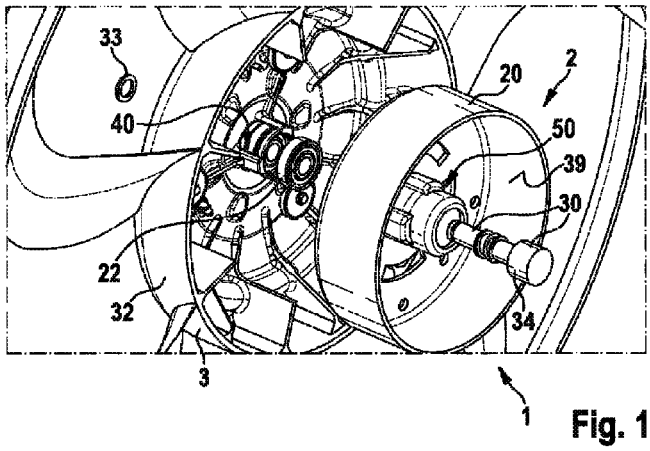
FIG. 1 shows a perspective view of the fan system.
Figure 2:
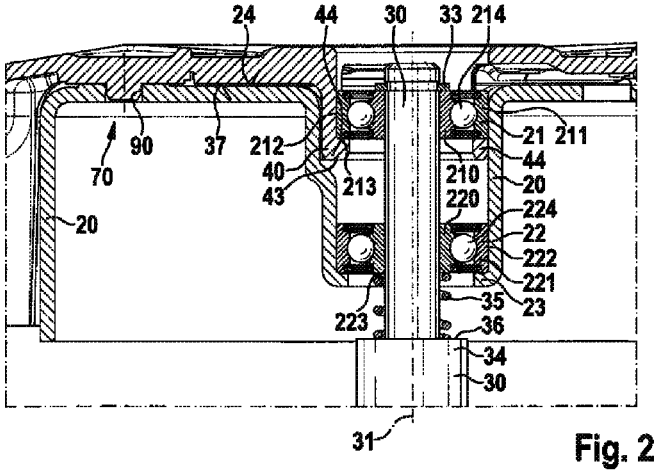
FIG. 2 shows a sectional view through the fan system shown in FIG. 1.
Figure 3:
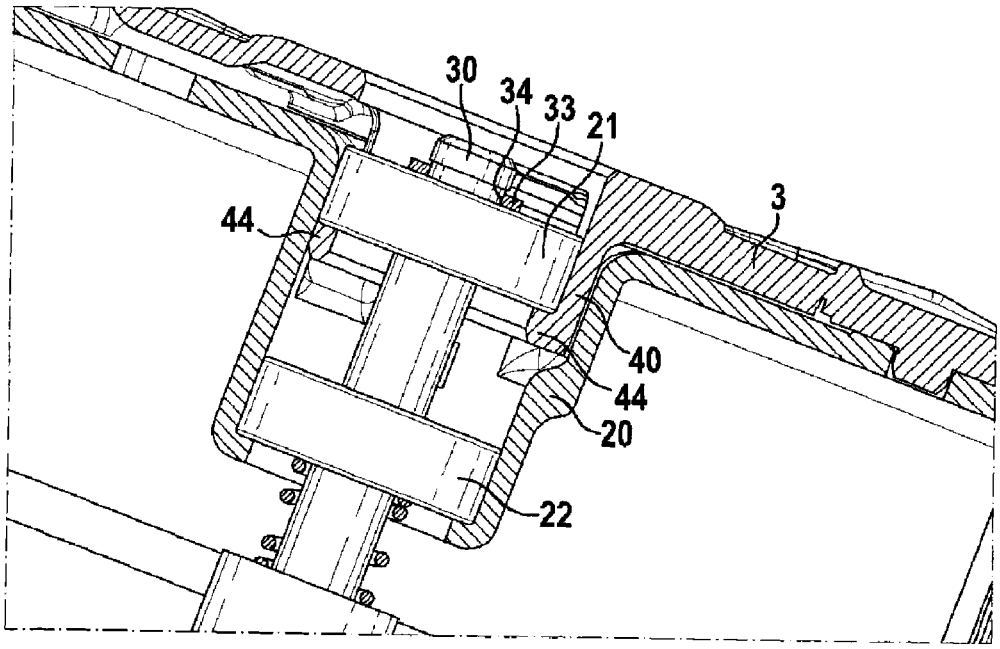
FIG. 3 shows a perspective sectional view through the fan system shown in FIGS. 1 and 2.
Figure 4:
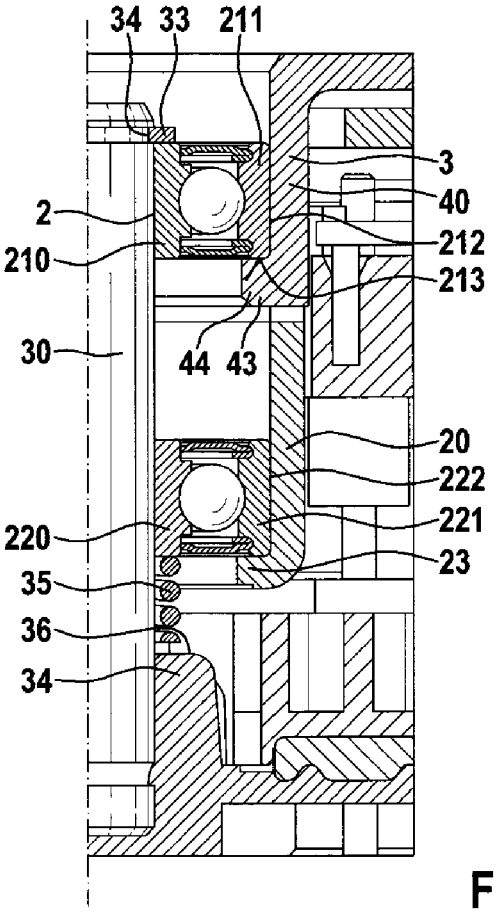
FIG. 4 shows a detail of the section shown in FIG. 2.
Figure 5:
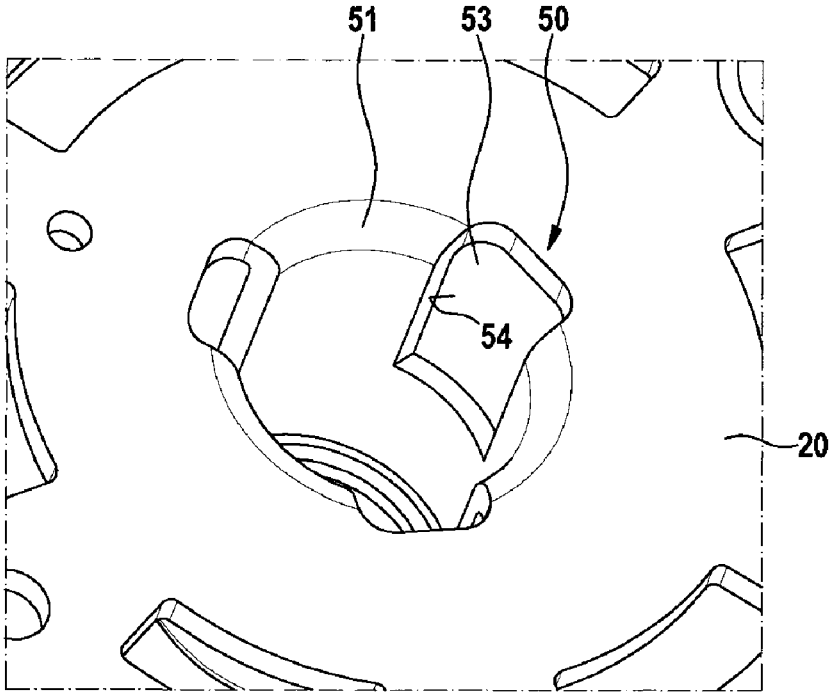
FIG. 5 shows a perspective view of a portion of a pole housing of the fan system shown in FIGS. 1 to 4.

FIGS. 1 to 7 are to be explained jointly owing to the overall relationship between the individual components.

FIGS. 1 to 7 show a fan system 1 having an electric machine 2 and an impeller wheel 3. The impeller wheel 3 comprises a plurality of fan blades 4 which are configured, given rotation of the impeller wheel 3, to deliver cooling air to a water cooler and/or oil cooler of an internal combustion engine (not illustrated). The electric machine 2 comprises a pole housing 20 which is of pot-shaped design and is mounted on an upright shaft 30. The electric machine 2 is embodied as an external rotor in the embodiment, wherein for reasons of clarity the figures do not illustrate magnets and coils. The magnets are arranged on an inner circumferential face 39 of the pole housing 20. A fan pot 32 of the impeller wheel 3 engages radially around the outside of the pole housing 20. Both the impeller wheel 3 and the pole housing 20 are mounted so as to be rotatable about a rotational axis 31, corresponding to a longitudinal axis of the shaft 30, owing to the bearings 21, 22 (see FIGS. 2 and 3).

In order to mount the pole housing 20, a first bearing 21 is provided at the axial upper end, and the second bearing 22 is provided at a lower end of the shaft 30. The upper first bearing 21 is limited in its axial mobility on the shaft 30 in the direction of the upper end (FIG. 2) by a circlip 33. The shaft 30 also has, at a lower end (cf. FIG. 2), a shoulder 34 on which a compression spring 35 is arranged. The compression spring 35 bears with one end against an end side 36 of the shoulder 34 of the shaft 30. With the other end, the compression spring 35 bears against the second bearing 22. The pole housing 20 engages completely around the second bearing 22 here, both radially and axially. The pole housing 20 has, below the second bearing 22 in FIG. 2, a stop 23 on the second bearing 22, which stop 23 prevents axial displacement of the second bearing 22 in the direction of the shoulder 34 of the shaft 30 (in the downward direction in FIG. 2). Both the first bearing 21 and the second bearing 22 are embodied as roller bearings, here as ball bearings. Alternatively, sliding bearings may also be conceivable.

The first bearing 21 and the second bearing 22 each have an inner ring 210, 220 and an outer ring 211 and 221. In contrast to the radially outer bearing seat 222 of the second bearing 22, which is formed completely by the pole housing 20, the first bearing 21 has a radially outer bearing seat 212 which is formed by the pole housing 20 and the impeller wheel 3. For this purpose the impeller wheel 3 has a first engagement element 40 (cf. FIGS. 4 and 7). The pole housing 20 has a second engagement element 50. The second engagement element 50 is designed to correspond to the first engagement element 40, with the result that in the mounted state of the fan system 1 the two engagement elements 40, 50 engage one in the other. In addition, the inner side 41 of the first engagement element 40 and the inner side 51 of the second engagement element 50 together form the bearing seat 212 in the form of a ring for the first bearing 21. In the embodiment, the tolerances are selected in such a way that the bearing seat 212 has a clearance fit with respect to the outer ring 211 of the first bearing 21. In addition, the inner ring 210 is also seated on the shaft 30 with a clearance fit.

Figure 7:
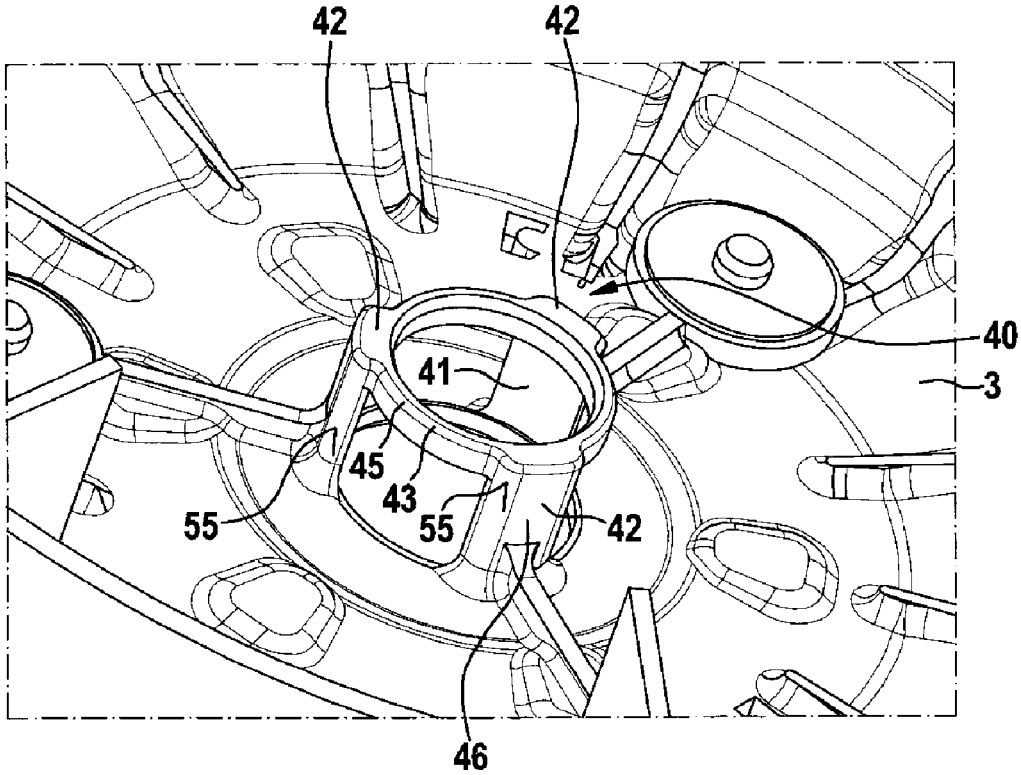
FIG. 7 shows a perspective partial view of an impeller wheel of the fan system.

The first engagement element 40 has, as illustrated in FIG. 7, a plurality of ribs 42 which are oriented parallel to the rotational axis 31 of the impeller wheel 3 and/or of the pole housing 20. The ribs 42 are distributed uniformly in the circumferential direction about the rotational axis 31 on the impeller wheel 3. A nonuniform arrangement for defining a predefined orientation of the impeller wheel 3 with respect to the pole housing 20 is also conceivable. The ribs 42 are connected in an upper section by an annular section 43. As a result, the annular section 43 ensures an axial stabilization of the ribs 42 and at the same time forms a stop 44 which is oriented radially toward the inside with respect to the rotational axis 31 of the shaft 30. Bearing against the stop 44 is a side face 213 of the outer bearing ring 211 of the first bearing 21. The annular section 43 can alternatively also be embodied as a section 43 in the form of a partial ring and in each case connects just some of the ribs 42 to one another. In addition, a chamfer 45 is provided on an upper external outer edge of the annular section 43 in order to be able to insert the first engagement element 40 easily into the second engagement element 50 during the assembly of the electric machine. In the embodiment the ribs 42 are embodied and oriented in the form of a partial ring in the circumferential direction. In addition, said ribs 42 extend parallel to the rotational axis 31 in the axial direction. However, other cross sections, such as triangular, rectangular or circular, are also conceivable.

Figure 6:
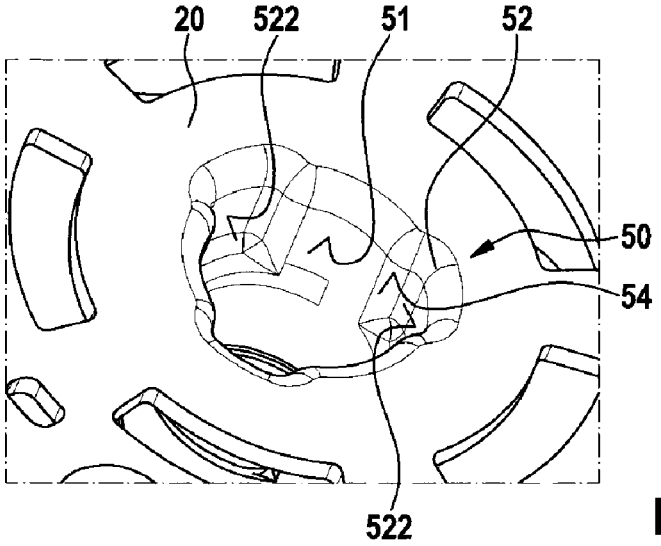
FIG. 6 shows a variant of the embodiment of the pole housing shown in FIG. 5.

The second engagement element 50 is embodied as a cutout 53 (cf. FIG. 5) or as a depression (52) (cf. FIG. 6). The depressions 52 and recesses 53 are configured in such a way that the corresponding ribs 42 engage in the depression 52 or cutout 53. In this context, each rib 42 has an outer face 46 and in each case a side face 55 in the circumferential direction. In this context, the outer face 46 of the rib 42 is understood to be an external circumferential face. The side face 55 is understood to be exclusively the faces of the ribs 42 oriented in the circumferential direction. The depression 52 also comprises an inner face 522 lying radially on the outside. Between the inner face 522 and the inside 51, the depression 52 has a side face 54 which is embodied in a way corresponding to the side face 55 of the rib 42. Depending on the purpose of use, various configurations of the engagement elements 40, 50 are conceivable. In the embodiment shown in FIGS. 1 to 7, the rib 42 is embodied with respect to the depression 52 or cutout 53 in such a way that although the rib 42 engages in the depression 52 or cutout 53, it is, however, spaced apart on the outer face 46 with respect to the corresponding inner face 522 or on the side faces 55 with respect to the corresponding side faces 54 of the depression 52 or 53. This configuration ensures a long service life and the possibility of easy assembly of the fan system 1.

Alternatively it is conceivable that the geometry of the ribs 42 and that of the depressions 53 are selected in such a way that the ribs 42 are spaced apart with their outer face 46 with respect to a corresponding inner face 522 of the depressions 52 but the side faces 54, 55 of the rib 42 or of the depression 52 or cutout 52 bear one against the other. The opposite case is also conceivable in which the side faces 54, 55 are spaced apart from one another but the outer face 46 bears against the inner face 522 of the depression 52. This ensures that the impeller wheel 3 and the pole housing 20 can be easily fitted one into the other with simultaneous precise orientation. In addition it is conceivable that the rib 42 bears both against the side face 55 and against the outer face 46 on the depression 52 or cutout 53.

In the assembled state and therefore as a result of the formation of the bearing seat 212 (cf. FIGS. 2 and 3), the first bearing 21 bears both against the inside 41 of the impeller wheel 3 and against the inside 51 of the pole housing 20. The position of the first bearing 21 is secured axially in a first axial direction on the inner ring 210 of the first bearing 21 by the circlip 33 which engages in a groove 34 in the shaft 30. A second axial direction, which is opposed to the first axial direction, is bounded by the stop 44, formed by the impeller wheel 3, of the first engagement element 40 which bears against the outer ring 211 of the first bearing 21. In this context, the stop 44 is arranged on the opposite side with respect to the circlip 33. As a result of this arrangement, the first bearing 21 can be attached by means of a clearance fit both on the shaft 30 and on the inside 41, 51 of the pole housing 20 or of the impeller wheel 3. There is therefore no need for a costly injection molding process for attaching the bearing 21, with the result that the first bearing 21 can be easily and cost-effectively arranged in the impeller wheel system 1.

The second bearing 22 is attached radially on the outside in its bearing seat 222 in the pole housing 20 radially on the outside to the outer ring 221 by means of a press fit. The inner ring 220 of the second bearing is seated on the shaft 30 by means of a clearance fit. One of the ends of the compression spring 35 bears against a side face 223 of the inner ring 220 of the second bearing 22 which faces the shoulder 34 of the shaft 30.

The compression spring 35 is provided for defining the position of the impeller wheel 3 or of the pole housing 20. In this context, the compression spring 35 builds up a compression force between the shoulder 34 of the shaft 30 and the inner ring 220 of the second bearing 22. Owing to the clearance fit between the inner ring 222 and the shaft 30, the inner ring 222 can be displaced here in its axial position along the shaft 30. The compression force is passed on to the outer ring 221 of the second bearing 22 via roller bodies 224 of the second bearing 22. The compression force of the compression spring 35 is passed on to the pole housing 20 on the basis of the press fit of the outer ring 221 in its bearing seat 222 in the pole housing 20. The pole housing 20 passes on the compression force to the impeller wheel 3 via an end face 24 of the pole housing 20, against which the pole housing 20 bears on an end face 37 of the impeller wheel 3. The compression force of the compression spring 35 is passed on into the stop 44 of the first engagement element 40 via the end face 37 of the impeller wheel 3. The stop 44 presses here against a side face 213 of the outer ring 211 of the first bearing 21 which is assigned to the stop 44. The compression force of the compression spring 35 is passed on via roller bodies 214 of the first bearing 21 to the inner ring 210 of the first bearing 21, which inner ring 210 is then supported on the circlip 33 opposite the stop 44 and in the process passes on the compression force into the shaft 30, with the result that the compression force flux is closed with respect to the compression spring 35 via the shaft 30. As a result of this configuration, the axial and also the radial position of the impeller wheel 3 and/or of the pole housing 20 is secured. In addition, the manufacture and assembly of the impeller wheel 3 and/or of the pole housing 20 are simplified by this bearing arrangement.

Figure 8:
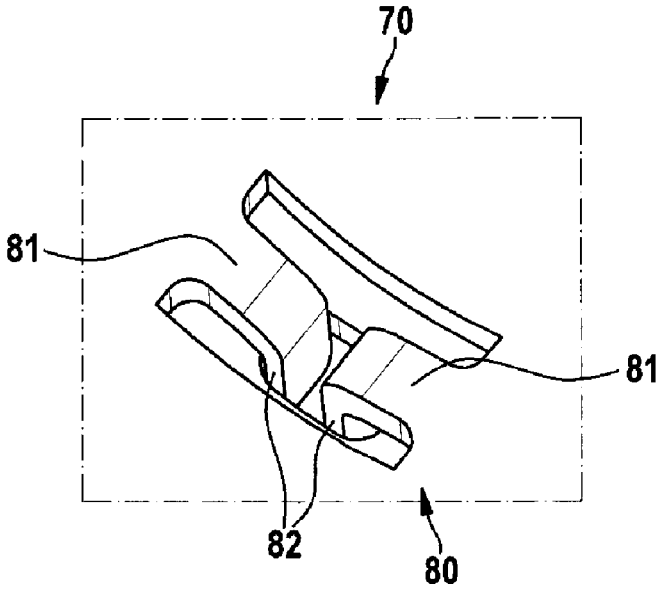
FIGS. 8 and 9 show perspective views of two coupling elements in different embodiments.
Figure 9:
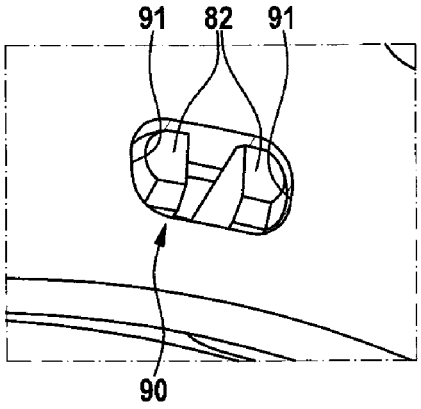

FIGS. 8 and 9 show perspective views of a coupling device 70 according to a first embodiment. The coupling device 70 comprises a first coupling element 80 which has in each case two webs 81 which are oriented opposite one another in the circumferential direction and at each end of which a spring section 82 is provided. The spring section 82 is oriented transversely with respect to the web 81 and therefore in the direction of the longitudinal axis 31 of the shaft 30 here. The spring elements 82 engage in a second coupling element 90 which is embodied as a recess in the form of a partial ring in the pole housing 20. In this context, the spring sections 82 are embodied in such a way that in the mounted state they engage under tension in the second coupling element 90 and bear against respectively correspondingly assigned contact faces 91 of the second coupling element 90. The coupling device 70 is preferably arranged radially on the outside on the end face 24 of the pole housing 20. In this way, a particularly large torque can be transmitted to the impeller wheel 3 from the pole housing 20 via the coupling device 70. However, it is also conceivable to arrange the coupling device 70 at other positions on the pole housing 20 or on the fan pot 32. The coupling device 70 has the advantage that, as a result of the spring sections 82, the torque of the electric machine 2 is transmitted gently from the pole housing 20 to the impeller wheel 3. In addition, as a result of the clamping of the spring sections 82 in the second coupling element 90, the assembly is facilitated by simple plugging of the pole housing 20 and of the impeller wheel 3 one into the other. For simple plugging of one into the other, the spring sections 82 have at their respective ends a chamfer 83 which is arranged on the edges assigned to the contact face 91.

Figure 10:
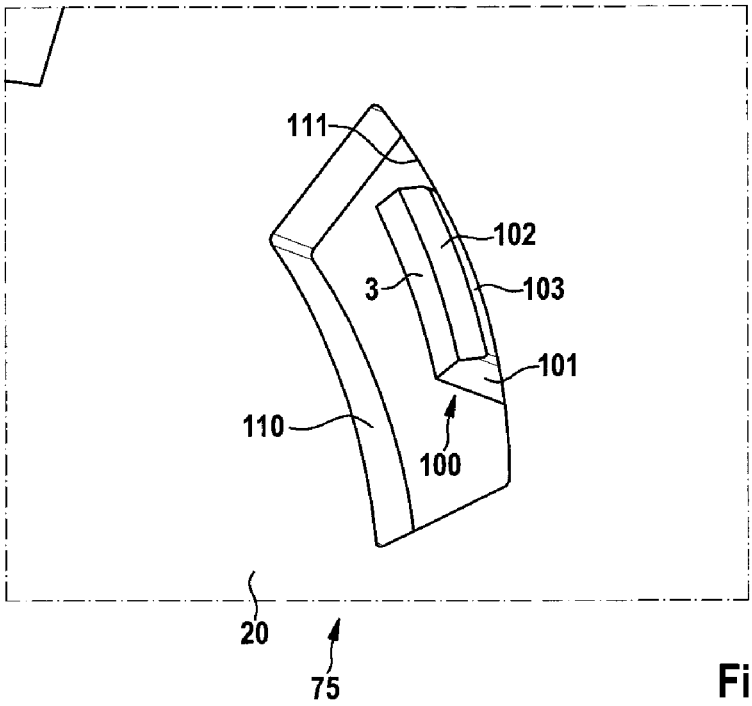
FIG. 10 shows a spatial view of a receptacle of the coupling element.
Figure 11:
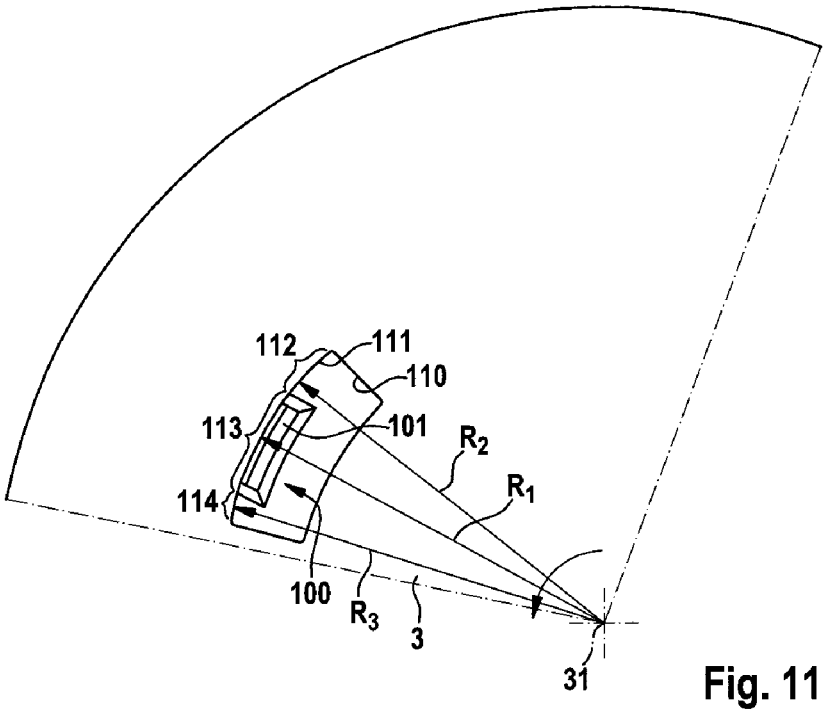
FIG. 11 shows a plan view of a receptacle of the coupling element.

FIG. 10 shows a perspective view and FIG. 11 shows a plan view of a coupling device 75 according to a second embodiment. The coupling device 75 has a first coupling element 100 and a second coupling element 110. The first coupling element 100 comprises a web 101 which is embodied in the form of a partial ring and is oriented parallel to the longitudinal axis 31 of the shaft 30. The web 101 is embodied here itself as a spring element and has a chamfer 102 on the radially outer end edge of the free end of the web 101. In addition, a sliding face 103 is provided on a radially outer circumferential face.

The second coupling element 110 is embodied as a recess in the pole housing 20. In the assembled state, the first coupling element 100 engages in the second coupling element 110. The second coupling element 110 comprises a sliding contour 111 which is arranged radially on the outside and opposite the sliding face 103 of the first coupling element 100. The sliding contour 111 has three sections 112, 113, 114 which are arranged adjacent to one another. In the embodiment, a first section 113 is arranged between a second section 112 and a third section 114. The first section 113 has here a radius $R_1$ which is larger with respect to the longitudinal axis 31 of the shaft 30 than a radius $R_2$ of the second section 112 or the radius $R_3$ of the third section 114. In addition, a width of the second section 112 is larger than a width of the third section 114. The width of the respective section is understood to be an extent of the respective section in the circumferential direction. The width of the first section 113 corresponds here to a width of the web 101 of the first coupling element 100 and is larger than the width of the second section 112 or of the third section 114. However, it is also conceivable that the second section 112 has the same width as the third section 114.

The main rotational direction of the fan system 1 is predefined by the delivery direction of the impeller wheel 3. In the embodiment the rotational direction is opposed to the clockwise direction, and it is illustrated in FIG. 11 by means of an arrow.

When the electric machine 2 starts, the pole housing 20 of the electric machine 2 is made to rotate. In order to entrain the impeller wheel 3, the pole housing 20 rotates with respect to the impeller wheel 3. In the process, the sliding face 103 of the web 101 bears against the first section 113 of the sliding contour 111 of the second coupling element 110. When the pole housing 20 starts, the pole housing rotates with respect to the impeller wheel 3, with the result that the sliding face 103 bears at least partially in the second section 112 of the sliding contour 111. As a result of the relatively small radius $R_2$ of the second section 112, the web 101 is pressed radially inward during the rotation of the pole housing 20 with respect to the impeller wheel 3, with the result that the web 101 is tensioned with respect to the sliding contour 111 and a frictional force between the sliding face 103 and the sliding contour 111 is increased. The pole housing 20 rotates here with respect to the impeller wheel 3 until the frictional force between the sliding face 103 and the sliding contour 111 is high enough for the torque which is to be transmitted by the coupling device 75 to be transmitted from the pole housing 20 to the impeller wheel by means of the frictional force. This configuration has the advantage that the impeller wheel 3 starts gently and therefore the impeller wheel 3 is prevented from impacting against further components during the starting process.

If the impeller wheel 3 is braked or the electric machine 2 is switched off, the impeller wheel 3 also rotates with respect to the pole housing 20, but in the opposite direction to the rotational direction described above. The sliding process corresponds to the sliding process described above in the opposite direction, wherein the resetting of the impeller wheel 3 or of the web 101 from the second section 112 into the first section 113 by means of the relatively small radius $R_2$ with respect to the first radius $R_1$ of the first section 113 is assisted. After the first section 113 slides through, the impeller wheel 3 rotates with respect to the pole housing 20 in such a way that the web 101 bears against the sliding contour 111 in the section 114 and is pressed radially inward by the sliding contour 111 of the third section 114, and therefore the web 10 is tensioned once more on the sliding contour 111. Owing to the relatively small torque to be transmitted, in the embodiment the width of the third section 114 is selected to be smaller than the width of the second section 112, with the result that given identical radii of the two sections 112, 114 the web 101 in the third section is tensioned less. It is also conceivable that the third section 114 has a smaller radius $R_3$ than the second section 112, in order to compensate for the relatively short sliding section or relatively small width compared to the second section 112.

What is claimed is:

1. A fan system (1) for a cooling system of an internal combustion engine, comprising an electric machine (2) and an impeller wheel (3), wherein the electric machine (2) comprises a pole housing (20), which is rotatably mounted by means of a bearing (21), wherein the impeller wheel (3) is coupled to the pole housing (20) of the electric machine (2), wherein the impeller wheel (3) has a first engagement element (40), and the pole housing (20) has a second engagement element (50) which corresponds to the first engagement element (40), and wherein the first and second engagement elements (40, 50) engage one in the other in such a way that a bearing seat (212) for the bearing (21) of the pole housing (20) is formed jointly by both of the first and second engagement elements (40, 50).

2. The fan system (1) according to claim 1, characterized in that the engagement elements (40, 50) form an annular bearing seat (212) which is configured to accommodate the bearing (21).

3. The fan system (1) according to claim 1, characterized in that the impeller wheel (3) has a stop (44) which is configured to define an axial position of the bearing (21) in at least one direction.

4. The fan system (1) according to claim 1, characterized in that the engagement element (40) of the pole housing (20) is one of a cutout (53) and a depression (52).

5. The fan system (1) according to claim 4, characterized in that the impeller wheel (3) has at least one rib (42) which is designed to engage in the depression (52) or cutout (53) in the pole housing (20).

6. The fan system (1) according to claim 5, characterized in that at least two ribs (42) are connected in an upper region by a section (40) in the form of a partial ring.

7. The fan system (1) according to claim 1, further including a coupling device (70; 75) which comprises a first coupling element (80; 100) and a second coupling element (90; 110) which corresponds to the first coupling element, wherein the first coupling element (80; 100) is arranged on the pole housing (20), and the second coupling element (90; 110) is arranged on the impeller wheel (3), wherein the coupling elements (80; 100; 90; 110) are configured to engage one in the other and to transmit a torque.

8. The fan system (1) according to claim 7, characterized in that the first coupling element (80; 100) comprises at least one web (81; 101) and the second coupling element (90; 110) is a recess, wherein the web (81; 101) engages under tension in the recess.

9. The fan system (1) according to claim 8, characterized in that the second coupling element (110) is a recess in the form of a partial ring, and comprises a sliding contour (110) with at least a first section (113) and a second section (112, 114), wherein the first section has a first radius ($R_1$), and the second section has a second radius ($R_2$, $R_3$), wherein the second radius ($R_2$, $R_3$) is smaller than the first radius ($R_1$).

* * * * *